US005324165A

United States Patent [19]

Charbonnel et al.

[11] Patent Number: 5,324,165

[45] Date of Patent: Jun. 28, 1994

[54] SEALING STRUCTURE FOR A PIVOTING BLADE OF A GAS TURBINE

[75] Inventors: Jean-Louis Charbonnel, Le Mee Sur Seine; Jacky S. Naudet, Bondoufle, both of France

[73] Assignee: Societe Nationale d'Etude et de Construction de Moteurs d'Aviation "Snecma", Paris, France

[21] Appl. No.: 58,760

[22] Filed: May 10, 1993

[30] Foreign Application Priority Data

May 20, 1992 [FR] France ..... 92 06101

[51] Int. Cl.[5] ..... F01D 17/16

[52] U.S. Cl. ..... 415/160; 415/230

[58] Field of Search ..... 415/148, 150, 151, 155, 415/159-165, 230, 231

[56] References Cited

U.S. PATENT DOCUMENTS 3,210,045 10/1965 Lindquist ..... 415/164
4,792,277 12/1988 Dittberner, Jr. et al. ..... 415/160

FOREIGN PATENT DOCUMENTS 2245068 3/1974 Fed. Rep. of Germany .
2452591 10/1980 France .
2016091 9/1979 United Kingdom .

*Primary Examiner*—Edward K. Look
*Assistant Examiner*—Christopher Verdier
*Attorney, Agent, or Firm*—Oblon, Spivak, McClelland, Maier & Neustadt

[57] ABSTRACT

A sealing structure for a gas turbine blade which pivots about a pivot shaft. A split ring is located in a groove on the shaft, in which the ring can be embedded and held by a bush. When the blade is fitted, the bush abuts against a wall of the stator, slides on the pivot shaft and frees the ring, which expands and forms the seal. The invention relates to gas turbines where the stator blades have a variable setting.

5 Claims, 2 Drawing Sheets

SEALING STRUCTURE FOR A PIVOTING BLADE OF A GAS TURBINE

BACKGROUND OF THE INVENTION

1. Field of the Invention

The invention relates to a sealing structure for a pivoting gas turbine blade.

2. Discussion of the Related Art

Numerous gas turbines of aircraft engines now have variable setting blades, i.e. which pivot so as to deflect to a greater or lesser extent a gas flow passing through the blades. It is therefore possible to maintain a satisfactory efficiency no matter what the turbine operating conditions. Such blades are more particularly encountered in the first stages of a high pressure compressor positioned downstream of a lower pressure compressor.

The pressure of the gases exposes the pivots of these blades to high thrust forces, which with progressive wear lead to an eccentricity of their section. The sealing of the annular flow where the gases circulate is then lost at the location of the pivots, so that it is necessary to fit gaskets.

French Patent 2,452,591 describes a device with several gaskets, whereof one is a split elastic joint located in a groove of the pivot. The insertion of such a split ring into the bearing can prove difficult and this is why the present invention proposes a structure making it possible in very simple and even automatic manner to carry out the said insertion.

SUMMARY OF THE INVENTION

The present invention therefore relates to a structure having a gas turbine blade pivoting about a pivot located in a bearing, a split elastic ring being placed in a groove of the pivot and designed so as to rub against the bearing by at least one first portion of the outer face, characterized by a bush engaged around the pivot on one side of the groove, the bush moving along the pivot between a position where it covers at least one second portion of the outer face and a position where it is remote from the ring, the groove and the ring being designed in such a way that the ring can be embedded in the groove at the location of the second portion.

The simplicity of the fitting is further improved if the two portions are separate, adjacent and separated by a shoulder of the outer face, or if the bush has a widening at an end opposite to the ring, the widening being designed so as to abut against a surface where the bearing issues. If these two features are combined, the first position corresponds to the abutment of the end of the bush on the shoulder and the second corresponds to the abutment of the widening on the surface where the bush issues.

The split or slit is advantageously sinuous or in the form of a labyrinth in order to limit the leaks through it. Finally, another bush can be engaged between the pivot and the bearing opposite to the first bush with respect to the split ring. This ensures the optimum pivot support.

BRIEF DESCRIPTION OF THE DRAWINGS

The invention is described in greater detail hereinafter relative to non-limitative embodiments and the attached drawings, wherein.

DESCRIPTION OF THE PREFERRED EMBODIMENT

Figure 1:
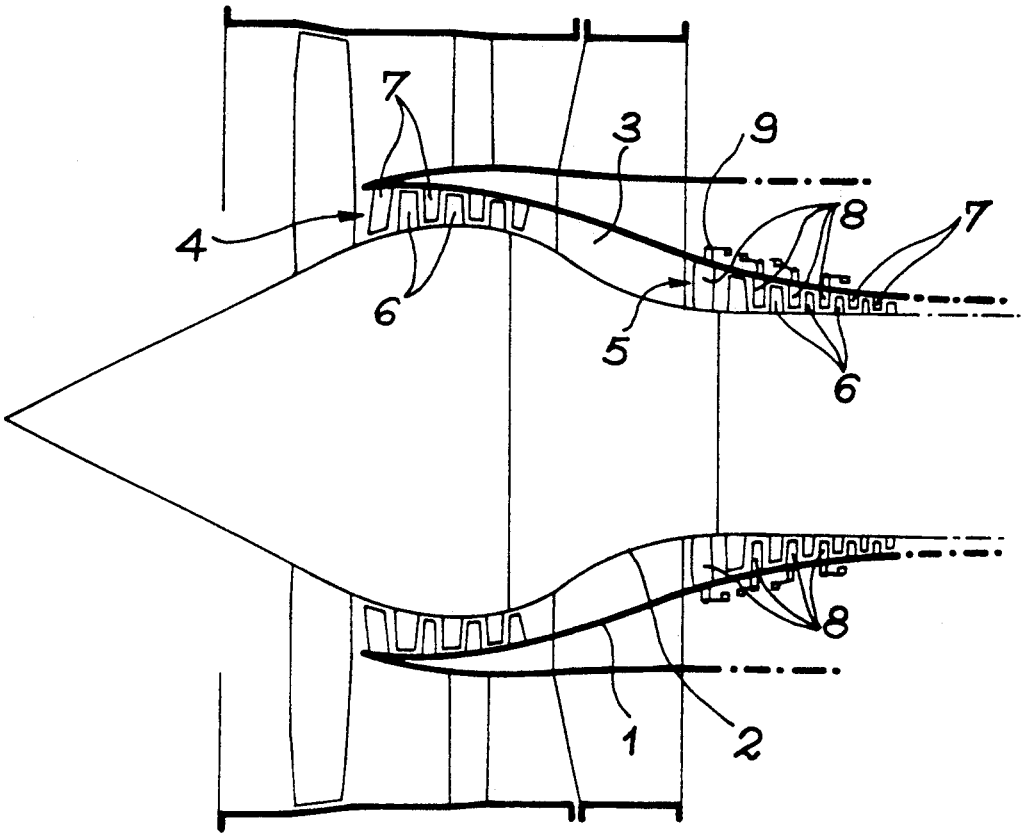
FIG. 1 illustrates part of a gas turbine.

Thus, FIG. 1 shows the gas turbine essentially constituted by a stator 1 surrounding a rotor 2 in order to define a substantially annular flow 3 through which pass the gases. A low pressure compressor 4 and a high pressure compressor 5 occupy two different parts of the annular flow 3 and are each constituted by rotor blade stages 6 integral therewith and stator blade stages 7 and 8, whereof most are fixed blades 7, but whereof some, namely the blades of the first four stages of the high pressure compressor 5, are variable setting blades 8 pivoting about a pivot 9 located in a bearing traversing the wall of the stator 1.

Figure 4:
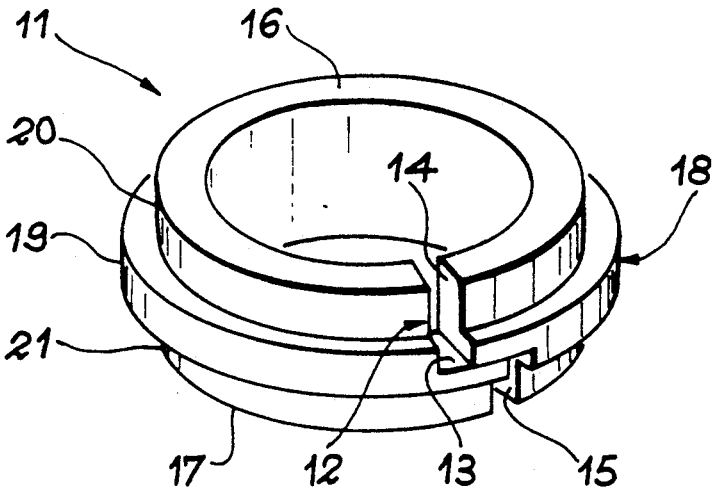
FIG. 4 illustrates the split ring in perspective.
Figure 3:
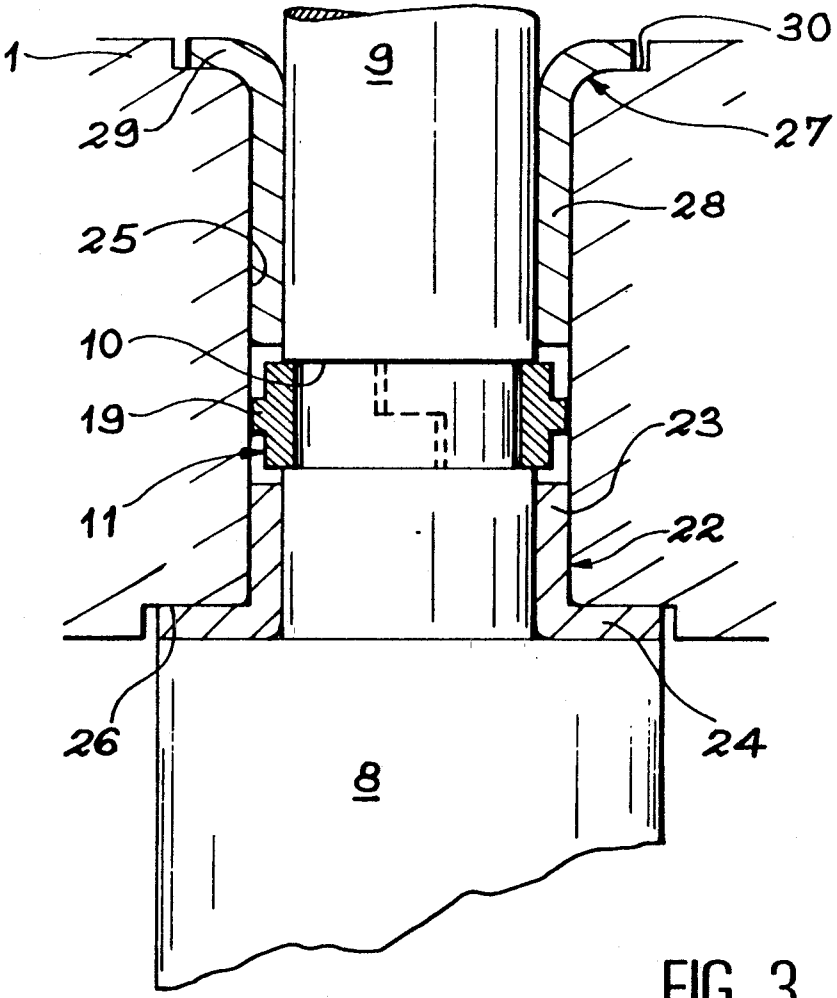
FIGS. 2 and 3 illustrates the structure according to the invention, respectively before and after fitting.
Figure 2:
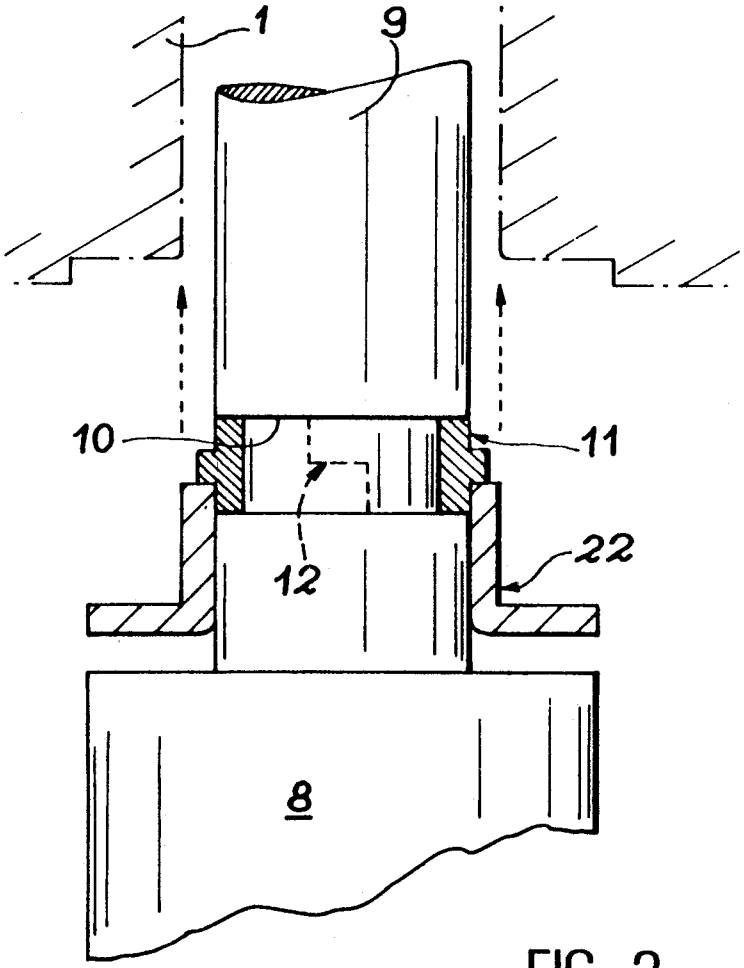

Reference should now be made to FIGS. 2, 3 and 4. In the pivot 9 is cut a groove 10, which houses a split ring 11 and whose split or slit is designated by the reference numeral 12. It is a labyrinth slit 12, i.e. instead of being straight it is sinuous and has here a circular arc portion 13 joining two straight portions 14, 15 for connection to the two axial edges 16, 17 of the ring 11. It is possible to see three portions on the outer face 18 of the ring 11, namely a crest portion 19 in the center of the ring 11 and two peripheral portions 20, 21 corresponding to smaller diameters of the ring 11. The groove 10 is designed in such a way that the material of the ring 11 in front of the peripheral portions 20, 21 is entirely contained in the groove 10 when the slit 12 is closed as a result of the contraction of the ring 11. Such a contraction can be brought about by a bush 22 sliding along the pivot 9 and positioned between the ring 11 and the blade 8. The bush 22, just prior to the fitting of the blade 8, is located on the stator 1 so as to occupy a position where it abuts against the crest of the ring 11 and covers one of the peripheral portions 21. When fitting is carried out, FIG. 3 shows that the bush 22 is displaced, because it is formed by a cylindrical portion 23 and a collar 24 constituting a widening at the end of the bush 22 opposite to the ring 11. The cylindrical portion 23 is introduced sliding freely in the bearing 25 of the stator 1 until the collar 24 abuts against the inner surface 26 of the stator 1, where the bearing 25 issues. It is then held while the embedding of the blade 8 and the pivot 9 continues until the blade 8 abuts against the collar 24. However, the ring 11 has then entirely escaped from the bush 22, which has permitted its expansion, so that the crest portion 19 now touches a portion of the surface of the bearing 25 and establishes the desired seal.

A second bush 27 can be inserted in the bearing 25 from the other side compared with the ring 11. This bush 27 can also be constituted by a cylindrical portion 28 and a widened collar portion 29 to serve as an abutment on the outer surface 30 of the stator 1. The pivot 9 is then well supported and can be screwed down by conventional fixing systems outside the stator 1. The bushes 22 and 27 are made from self-lubricating material and, in the conventional way, serve as support bearings for the pivot 9.

We claim:

1. A sealing structure for a pivoting blade of a gas turbine, comprising:

a pivot located in a bearing of a stator, the blade being pivotably mounted to said pivot, said pivot comprising a groove;

a split elastic ring positioned at said groove of the pivot, an outer face of said ring comprising at least one first portion and at least one second portion; and a bush positioned around the pivot and on one side of the groove, said bush being capable for movement along the pivot between a first position where the bush covers said second portion of the ring such that said ring and second portion are positioned within said groove, and a second position where the bush is spaced from the ring and the first portion of the ring abuts against said bearing.

2. A sealing structure according to claim 1, wherein said first and second portions of the outer face of the ring are adjacently positioned and separated by a shoulder.

3. A sealing structure according to claim 1, wherein said bush has a wide portion at an end opposite to the ring, the wide portion being designed so as to abut against a surface where the bearing issues.

4. A sealing structure according to claim 1, wherein, in said first position of said bush on said pivot, a circumference of said second portion of said ring is substantially equal to a circumference of said pivot.

5. A sealing structure according to claim 1, wherein, in said second position of said bush on said pivot, said ring expands to permit said abutment of said first portion of the ring against the bearing and establish a seal thereat.

* * * * *